US010134347B2

(12) United States Patent
Watanabe

(10) Patent No.: US 10,134,347 B2
(45) Date of Patent: Nov. 20, 2018

(54) DISPLAY DRIVER AND DISPLAY APPARATUS

(71) Applicant: LAPIS Semiconductor Co., Ltd., Yokohama (JP)

(72) Inventor: Yukinobu Watanabe, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 15/697,941

(22) Filed: Sep. 7, 2017

(65) Prior Publication Data

US 2018/0068623 A1 Mar. 8, 2018

(30) Foreign Application Priority Data

Sep. 8, 2016 (JP) ..... 2016-175197

(51) Int. Cl.
*G09G 3/36* (2006.01)

(52) U.S. Cl.
CPC ... *G09G 3/3614* (2013.01); *G09G 2310/0264* (2013.01); *G09G 2330/12* (2013.01)

(58) Field of Classification Search
CPC ..... G09G 3/3614; G09G 2330/12
See application file for complete search history.

(56) References Cited

U.S. PATENT DOCUMENTS 6,057,820 A * 5/2000 Irwin ..... G09G 3/3648 345/94
7,746,302 B2 * 6/2010 Lee ..... G09G 3/3655 345/87
7,796,125 B2 * 9/2010 Morita ..... G09G 3/3655 345/211
9,082,358 B2 * 7/2015 Yasue ..... G09G 3/3614
9,390,664 B2 * 7/2016 Yamazaki ..... G09G 3/3614
9,449,568 B2 * 9/2016 Hu ..... G09G 3/3614
2013/0002620 A1 * 1/2013 Du ..... G09G 3/003 345/204
2014/0015819 A1 * 1/2014 Yamazaki ..... G09G 3/3614 345/209
2015/0332651 A1 * 11/2015 Miyazawa ..... G09G 3/3614 345/211
2016/0293126 A1 * 10/2016 Uemura ..... G09G 3/3677

FOREIGN PATENT DOCUMENTS

JP 2001126402 A * 5/2001 ..... G11B 20/10009
JP 2005-309274 A 11/2005

* cited by examiner

*Primary Examiner* — Gene W Lee
(74) *Attorney, Agent, or Firm* — Rabin & Berdo, P.C.

(57) ABSTRACT

A display driver includes a driving voltage generation part that generates a voltage as a pixel driving voltage by inverting a polarity of a voltage representing a luminance level of each pixel based on a video signal according to a polarity inversion signal received via a transmission line, the polarity inversion signal alternately indicating either one of positive and negative polarities, and a polarity inversion abnormality detection part that generates an abnormality detection signal indicating an abnormality of the transmission line when the polarity inversion signal indicates only one constant polarity for a period of N frames (N is an integer greater than or equal to 2) of the video signal.

6 Claims, 7 Drawing Sheets

DISPLAY DRIVER AND DISPLAY APPARATUS

BACKGROUND OF THE INVENTION

1. Field of the Invention

The present invention relates to a display driver for driving a display device according to a video signal, and a display apparatus including the display driver.

2. Description of the Related Art

A source driver for driving a liquid crystal display panel inverts polarities of voltages applied to the liquid crystal display panel pixel by pixel, display line by display line, or at each frame period to prevent burning of the liquid crystal display. A source driver disclosed in Japanese Patent Application Laid-Open No. 2005-309274 applies signal voltages of which the polarities are inverted according to a polarity inversion signal supplied from a control unit, to source lines of a liquid crystal display panel.

There has been the following problem. When an abnormality such as a break occurs in wiring for transmitting the polarity inversion signal to the source driver, the polarities of the signal voltages applied to the source lines of the liquid crystal display panel are fixed on the source driver side, and burning of the liquid crystal display panel occurs.

SUMMARY OF THE INVENTION

An object of the present invention is to provide a display driver and a display apparatus that can prevent burning of the display device even if an abnormality such as a break occurs in the wiring for transmitting the polarity inversion signal to the display driver.

According to one aspect of the present invention, a display driver for supplying a pixel driving voltage corresponding to a video signal to a display device includes a driving voltage generation part configured to generate a voltage as the pixel driving voltage by inverting a polarity of a voltage representing a luminance level of each pixel based on the video signal according to a polarity inversion signal received via a transmission line, the polarity inversion signal alternately indicating either one of positive and negative polarities, and a polarity inversion abnormality detection part configured to generate an abnormality detection signal indicating an abnormality of the transmission line when the polarity inversion signal indicates only one constant polarity for a period of N frames (N is an integer greater than or equal to 2) of the video signal.

According to another aspect of the present invention, a display apparatus for displaying an image based on a video signal on a display device includes the display driver and a control part configured to supply a polarity inversion signal alternately indicating either one of positive and negative polarities to the display driver via a transmission line, wherein the display driver includes a driving voltage generation part configured to supply a voltage as a pixel driving voltage to the display device, the voltage being obtained by inverting a polarity of a voltage representing a luminance level of each pixel based on the video signal according to the polarity inversion signal received via the transmission line, and a polarity inversion abnormality detection part configured to supply an abnormality detection signal indicating an abnormality of the transmission line to the control part when the polarity inversion signal indicates only one constant polarity for a period of N frames (N is an integer greater than or equal to 2) of the video signal.

According to the present invention, when the polarity inversion signal supplied from the control part indicates a constant polarity for N frame periods, an abnormality is determined to occur in the line for transmitting the polarity inversion signal, and the abnormality detection signal for notifying of it is generated. The control part receiving the abnormality detection signal then performs control for stopping the supply of the pixel driving voltage to the display device on the display driver, whereby the occurrence of burning of the display device can be prevented.

DETAILED DESCRIPTION OF THE INVENTION

An embodiment of the present invention will be described in detail below with reference to the drawings.

Figure 1:
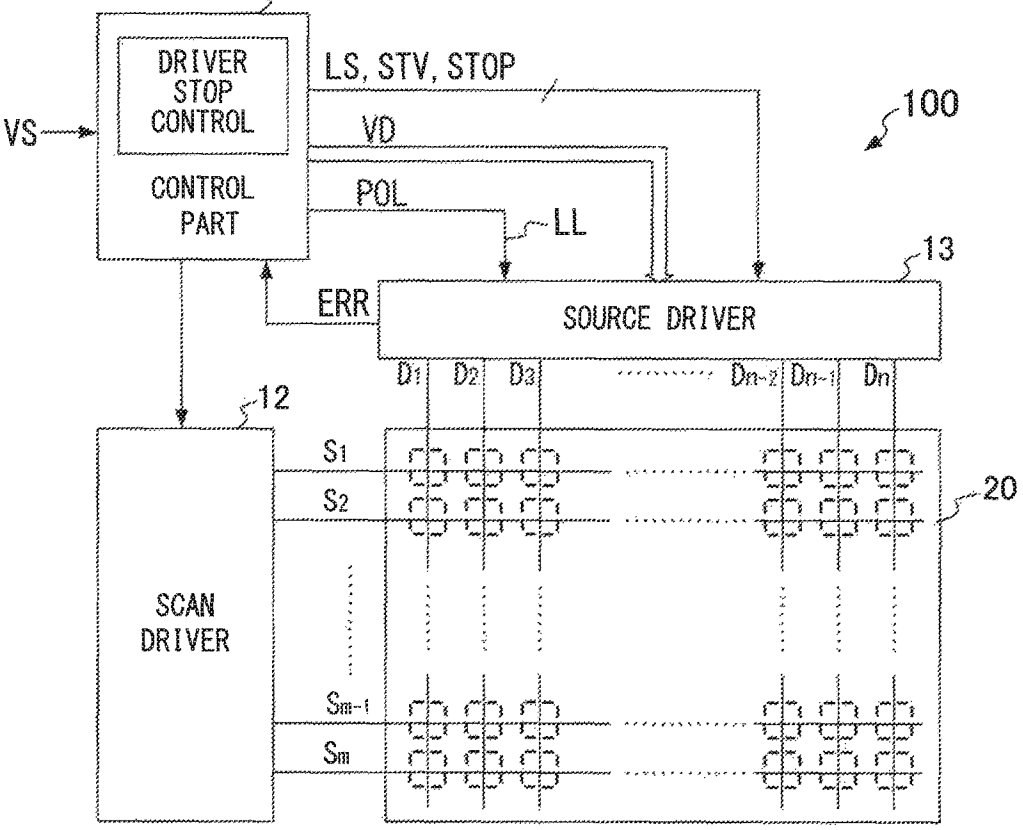
FIG. 1 is a block diagram showing a configuration of a display apparatus 100 including a display driver according to the present invention.

FIG. 1 is a block diagram showing a configuration of a display apparatus 100 including a source driver 13 serving as a display driver according to the present invention. As shown in FIG. 1, the display apparatus 100 includes a control part 11, a scan driver 12, the source driver 13, and a display device 20.

The display device 20 is an image display device including, for example, a liquid crystal display panel or an organic electroluminescence (EL) panel. The display device 20 includes m (m is a natural number greater than or equal to 2) horizontal scan lines $S_1$ to $S_m$ extending in a horizontal direction of a two-dimensional screen, and n (n is a natural number greater than or equal to 2) source lines $D_1$ to $D_n$ extending in a vertical direction of the two-dimensional screen. Display cells serving as pixels are formed in areas at respective intersections of the horizontal scan lines and the source lines, i.e., in areas surrounded by broken lines in FIG. 1.

The control part 11 generates a series of pieces of pixel data PD on the basis of an input video signal VS, and supplies a video data signal VD including the series of pieces of pixel data PD to the source driver 13. For example, the series of pieces of pixel data PD expresses luminance levels of respective pixels in six bits of luminance gradation. The control part 11 also supplies a line start signal LS and a frame start signal STV to the source driver 13. The line start signal LS indicates a top position of a series of n pieces of pixel data PD corresponding to each horizontal scan line. The frame start signal STV indicates a top position of a frame.

The control part 11 further supplies a binary polarity inversion signal POL to the source driver 13 via a transmission line LL. The polarity inversion signal POL alternates a state indicating a negative polarity and a state indicating a positive polarity.

Figure 2:
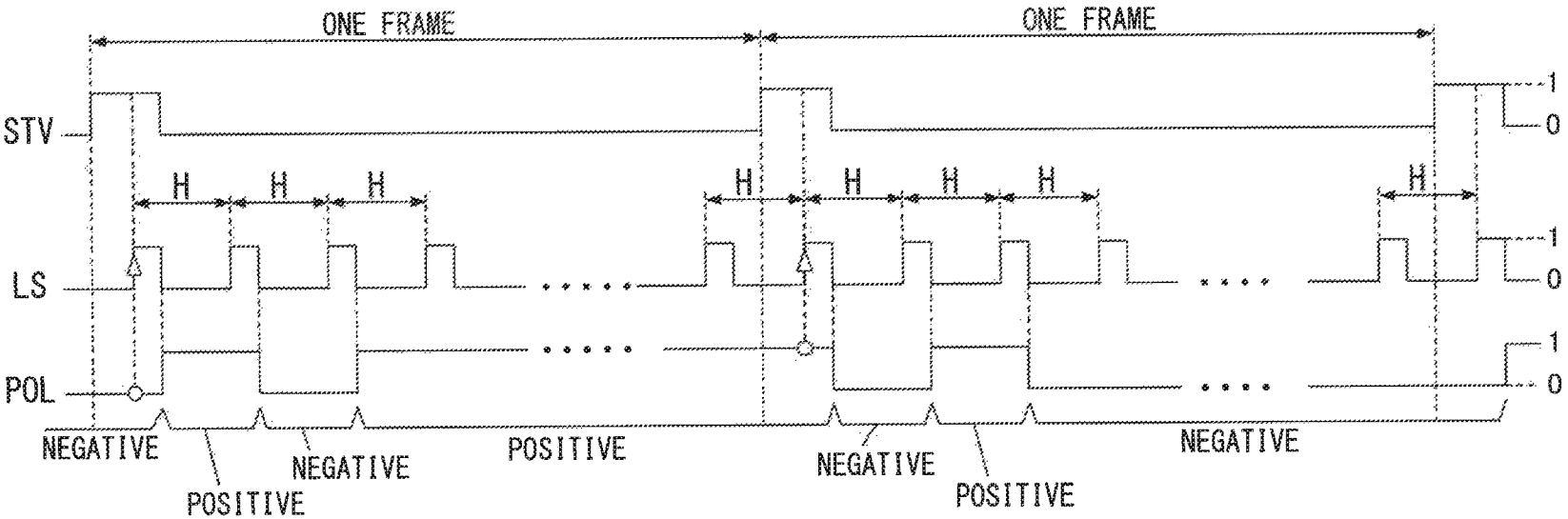
FIG. 2 is a timing chart showing an example of waveforms of a frame start signal STV, a line start signal LS, and a polarity inversion signal POL.

FIG. 2 is a timing chart showing an example of waveforms of the foregoing frame start signal STV, line start signal LS, and polarity inversion signal POL. As shown in FIG. 2, the frame start signal STV is a binary signal that has logic level 1 only in a predetermined period at the top of each frame, and maintains a state of logic level 0 in the other periods. The line start signal LS is a binary signal that has logic level 1 only in a predetermined period at the top of each horizontal scan period H, and maintains a state of logic level 0 in the other periods.

The polarity inversion signal POL is a binary signal that transitions from a state of logic level 0 indicating a negative polarity (or positive polarity) to a state of logic level 1 indicating a positive polarity (or negative polarity), or transitions from the state of logic level 1 indicating the positive polarity (or negative polarity) to the state of logic level 0 indicating the negative polarity (or positive polarity), at least once in each frame. In the example shown in FIG. 2, during two horizontal scan periods from the point in time of the first falling edge of the line start signal LS, the polarity inversion signal POL transitions alternately from the state of logic level 0 to the state of logic level 1 or from the state of logic level 1 to the state of logic level 0 in each horizontal scan period. The polarity inversion signal POL subsequently maintains the state of logic level 0 (or logic level 1) until the top of the next frame.

The control part 11 includes a driver stop control part. The driver stop control part supplies a driver stop signal STOP for stopping an operation of the source driver 13 to the source driver 13 when an abnormality detection signal ERR is supplied from the data driver 13.

The control part 11 detects a horizontal synchronization signal from the input video signal VS, and supplies the horizontal synchronization signal to the scan driver 12.

The scan driver 12 generates a horizontal scan pulse synchronous with the horizontal synchronization signal supplied from the control part 11. The scan driver 12 sequentially applies the horizontal scan pulse to each of the scan lines $S_1$ to $S_m$ of the display device 20 in a selective manner.

The source driver 13 generates n pixel driving voltages $G_1$ to $G_n$ for each horizontal scan line on the basis of the video data signal VD, the line start signal LS, the frame start signal STV, and the polarity inversion signal POL. The source driver 13 applies the pixel driving voltages $G_1$ to $G_n$ to the source lines $D_1$ to $D_n$ of the display device 20. On the basis of the line start signal LS, the frame start signal STV, and the polarity inversion signal POL, the source driver 13 generates and supplies the abnormality detection signal ERR to the control part 11. The abnormality detection signal ERR indicates whether an abnormality such as a break occurs in the transmission line LL for transmitting the polarity inversion signal POL. When the driver stop signal STOP is supplied from the control part 11, the source driver 13 stops supplying the pixel driving voltages $G_1$ to $G_n$ to the display device 20.

Figure 3:
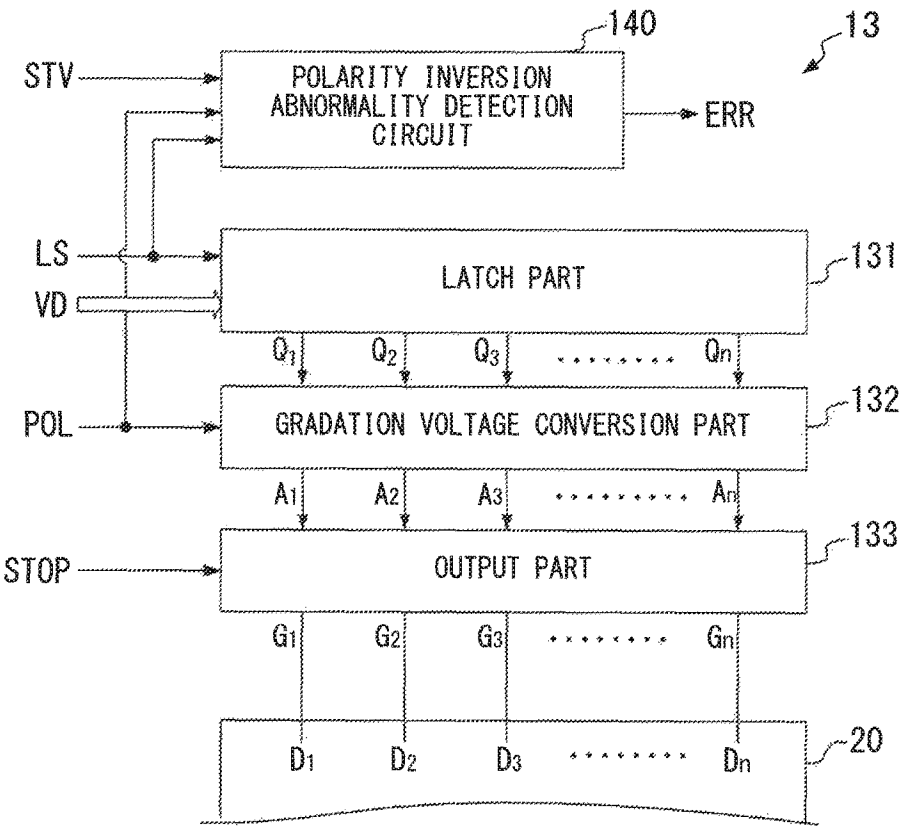
FIG. 3 is a block diagram showing an internal configuration of a source driver 13.

FIG. 3 is a block diagram showing an internal configuration of the source driver 13. As shown in FIG. 3, the source driver 13 includes a latch part 131, a gradation voltage conversion part 132, an output part 133, and a polarity inversion abnormality detection circuit 140.

The latch part 131 sequentially takes in the series of pieces of pixel data PD included in the video data signal VD supplied from the control part 11. The latch part 131 supplies n pieces of pixel data PD as pieces of pixel data $Q_1$ to $Q_n$ to the gradation voltage conversion part 132 each time one horizontal line of (n) pieces of pixel data PD are taken in according to the line start signal LS.

The gradation voltage conversion part 132 converts the pieces of pixel data $Q_1$ to $Q_n$ into gradation voltages $A_1$ to $A_n$ of positive or negative polarity. Each of the gradation voltages $A_1$ to $A_n$ has a voltage value representing in magnitude to luminance level expressed by the pixel data Q. For example, the gradation voltage conversion part 132 supplies the gradation voltages $A_1$ to $A_n$ having voltage values of positive polarity to the output part 133 while the polarity inversion signal POL having logic level 0 is supplied. The gradation voltage conversion part 132 supplies the gradation voltages $A_1$ to $A_n$ having voltage values of negative polarity to the output part 133 while the polarity inversion signal POL having logic level 1 is supplied.

The output part 133 generates voltages as the pixel driving voltages $G_1$ to $G_n$ by individually amplifying the gradation voltages $A_1$ to $A_n$ by a gain of 1, respectively. The output part 133 supplies the pixel driving voltages $G_1$ to $G_n$ to the source lines $D_1$ to $D_n$ of the display device 20. When, for example, the driver stop signal STOP having logic level 1 is supplied from the control part 11, the output part 133 stops supplying the pixel driving voltages $G_1$ to $G_n$ to the display device 20. The output part 133 thereby stops display of the display device 20.

The polarity inversion abnormality detection circuit 140 detects whether a connection abnormality such as a break occurs in the transmission line LL for transmitting the polarity inversion signal POL, on the basis of the line start signal LS, the frame start signal STV, and the polarity inversion signal POL. When an abnormality occurs, the polarity inversion abnormality detection circuit 140 supplies the abnormality detection signal ERR having logic level 1 to the control part 11. When no abnormality occurs, the polarity inversion abnormality detection circuit 140 supplies the abnormality detection signal ERR having logic level 0 to the control part 11.

Figure 4:
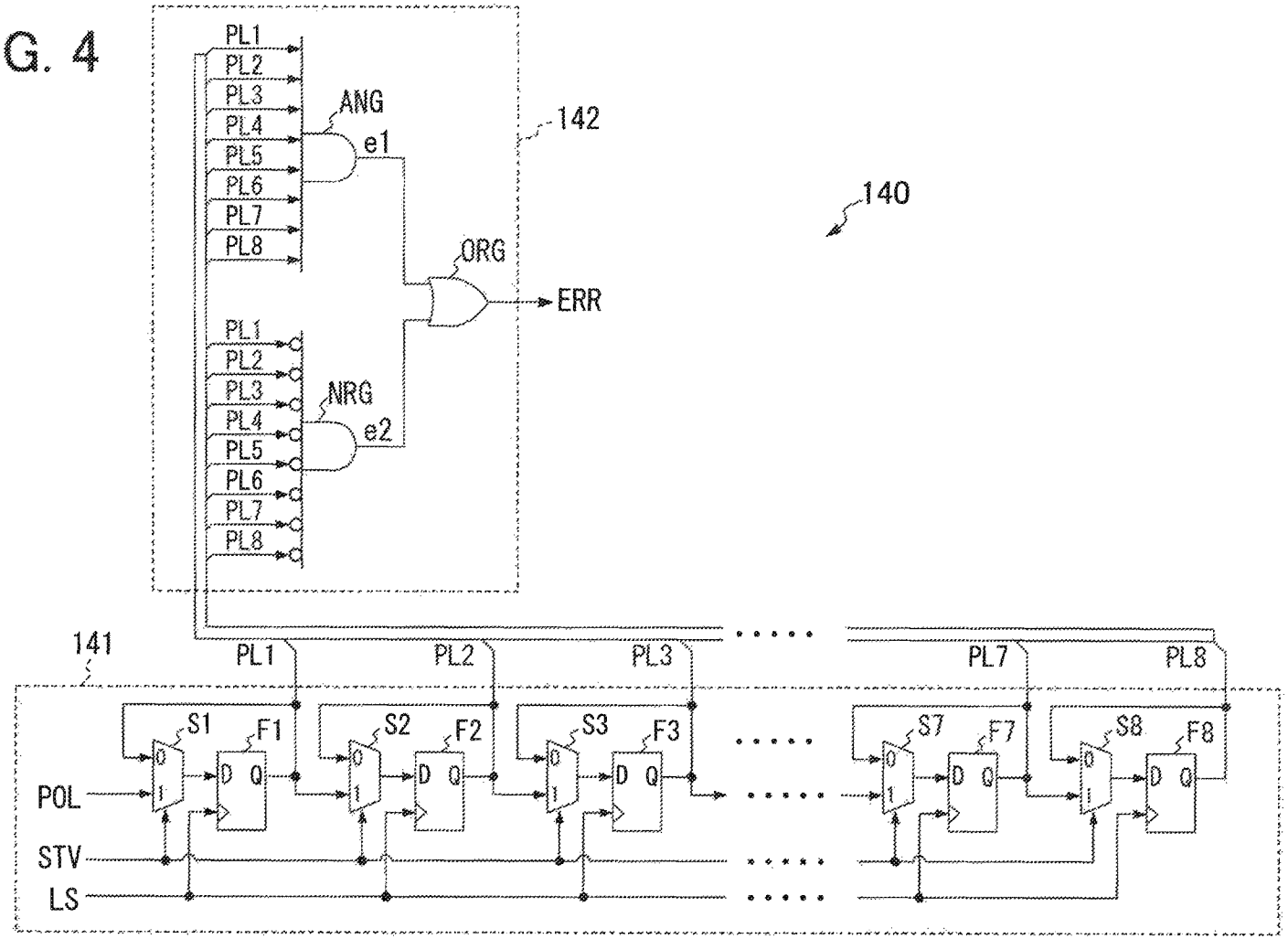
FIG. 4 is a circuit diagram showing an example of a configuration of a polarity inversion abnormality detection circuit 140.

FIG. 4 is a circuit diagram showing an example of a configuration of the polarity inversion abnormality detection circuit 140. As shown in FIG. 4, the polarity inversion abnormality detection circuit 140 includes a shift register part 141 and an abnormality determination part 142.

The shift register part 141 includes flip-flops F1 to F8 which receive the line start signal LS at their clock input terminals, and selectors S1 to S8 which are arranged at the preceding stages of the flip-flops F1 to F8, respectively.

The selector S1 supplies the polarity inversion signal POL to a data input terminal of the flip-flop F1 while the frame start signal STV indicates logic level 1. The selector S1 supplies the signal output from a data output terminal of the flip-flop F1 to the data input terminal of the same flip-flop F1 while the frame start signal STV indicates logic level 0.

The flip-flop F1 takes in and holds the signal supplied from the selector S1 at timing of the rising edge portion of the line start signal LS. The flip-flop F1 supplies the held signal as a polarity inversion signal PL1 to the selector S2 at the next stage and the abnormality determination part 142 via the data output terminal.

The selector S(k) (k is an integer of 2 to 8) supplies a polarity inversion signal PL(k−1) output from the flip-flop F(k−1) at the preceding stage to the data input terminal of the flip-flop F(k) at the next stage while the frame start signal STV indicates logic level 1. The selector S(k) supplies the signal output from the data output terminal of the flip-flop F(k) to the data input terminal of the same flip-flop F(k) while the frame start signal STV indicates logic level 0.

The flip-flop F(k) takes in and holds the signal supplied from the selector S(k) at timing of the rising edge portion of the line start signal LS. The flip-flop F(k) outputs the held signal as the polarity inversion signal PL(k) via the data output terminal. The polarity inversion signals PL (k) output from the flip-flops F(k), or more specifically, the polarity inversion signals PL2 to PL8 are supplied to the abnormality determination part 142.

With the foregoing configuration, the shift register part 141 takes the polarity inversion signal POL into the first stage flip-flop F1 at the timing of the rising edge of the line start signal LS and sequentially shifts the polarity inversion signal POL to the flip-flops F2 to F8 at the timing of the rising edges of the line start signal LS only while the frame start signal STV has logic level 1. More specifically, in the shift register part 141, for example, as shown in FIG. 2, the flip-flop F1 takes in the value (marked with a circle) of the polarity inversion signal POL at the timing (marked with a triangle) of the rising edge of the line start signal LS included in the period in which the frame start signal STV has logic level 1. The value of the polarity inversion signal POL taken into the flip-flop F1 in the period in which the frame start signal STV has logic level 1 is shifted and taken into the flip-flops in order of the flip-flops F2, F3, F4, . . . F8 at the timing (marked with triangles) of the respective rising edges of the line start signal LS. The signals output from the respective flip-flops F1 to F8, i.e., the values of the polarity inversion signal POL corresponding to the eight consecutive frames, taken in and stored at the respective frames, are supplied to the abnormality determination part 142 as the polarity inversion signals PL1 to PL8 in parallel.

The abnormality determination part 142 includes an AND gate circuit ANG, a NOR gate circuit NRG, and an OR gate ORG.

When all the polarity inversion signals PL1 to PL8 have logic level 1, the AND gate circuit ANG supplies an abnormality detection signal e1 of logic level 1, which indicates the occurrence of an abnormality, to the OR gate ORG. When at least one of the polarity inversion signals PL1 to PL8 has logic level 0, the AND gate circuit ANG supplies the abnormality detection signal e1 of logic level 0, which indicates the absence of an abnormality, to the OR gate ORG.

When all the polarity inversion signals PL1 to PL8 have logic level 0, the NOR gate circuit NRG supplies an abnormality detection signal e2 of logic level 1, which indicates the occurrence of an abnormality, to the OR gate ORG. When at least one of the polarity inversion signals PL1 to PL8 has logic level 1, the NOR gate circuit NRG supplies the abnormality detection signal e2 of logic level 0, which indicates the absence of an abnormality, to the OR gate ORG.

When at least either one of the abnormality detection signals e1 and e2 has logic level 1 indicating the occurrence of an abnormality, the OR gate ORG supplies the abnormality detection signal ERR of logic level 1, which indicates the occurrence of an abnormality in the transmission line LL, to the control part 11. When both the abnormality detection signals e1 and e2 have logic level 0 indicating the absence of an abnormality, the OR gate ORG supplies the abnormality detection signal ERR of logic level 0, which indicates the absence of an abnormality in the transmission line LL, to the control part 11.

With such a configuration, the abnormality determination part 142 determines that an abnormality occurs in the transmission line LL when all the values (PL1 to PL8) of the polarity inversion signal POL at the eight consecutive frames, taken in and stored at the respective frames by the shift register part 141, have logic level 0 or logic level 1. The abnormality determination part 142 then supplies the abnormality detection signal ERR having logic level 1 for notifying of it to the control part 11.

An operation of the polarity inversion abnormality detection circuit 140 shown in FIG. 4 will be described below with reference to the timing charts shown in FIGS. 5 to 7.

Figure 5:
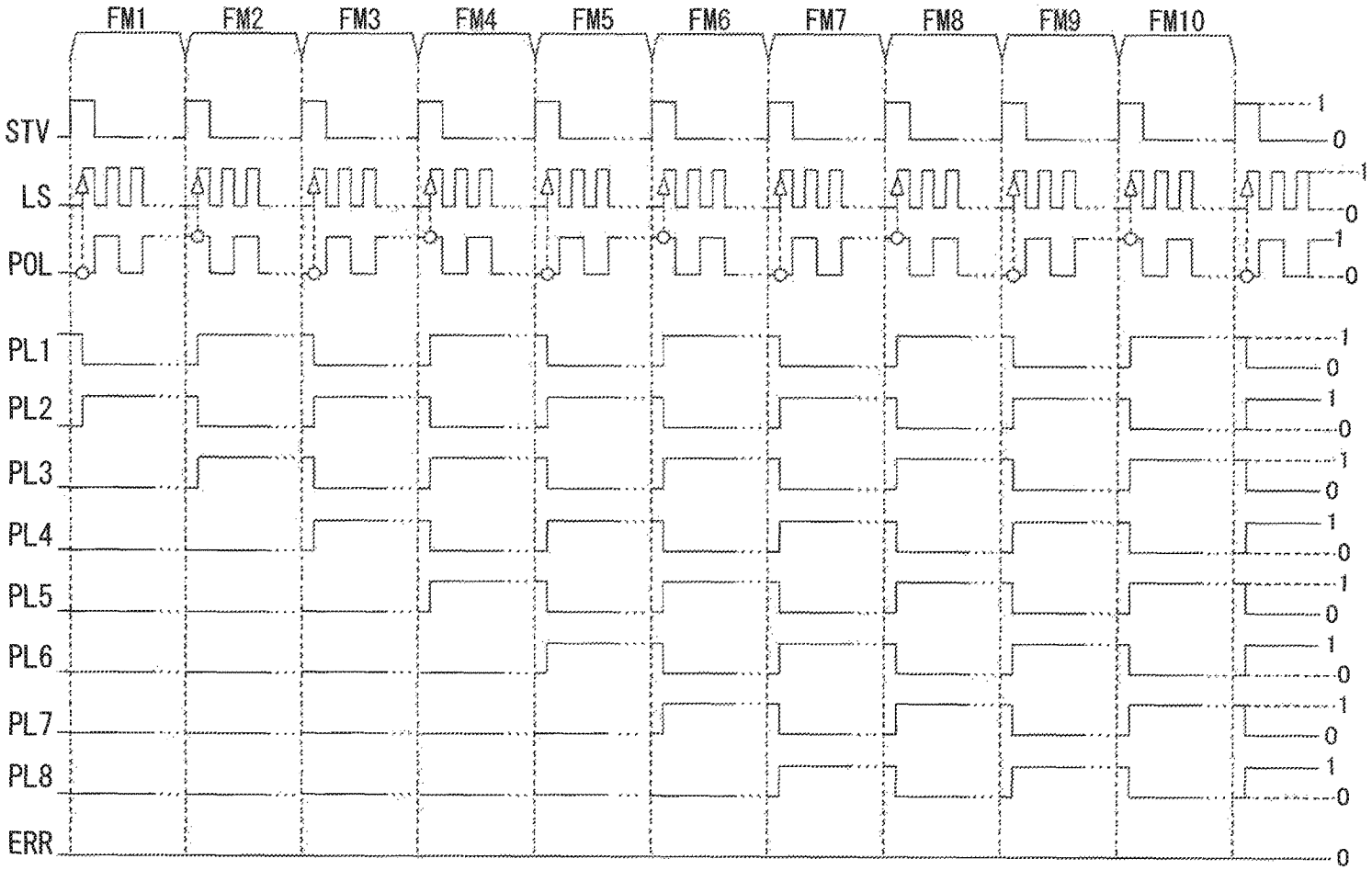
FIG. 5 is a first timing chart for describing an operation of the polarity inversion abnormality detection circuit 140.

For example, suppose that, as shown in FIG. 5, the control part 11 supplies the polarity inversion signal POL that inverts the polarities of the pixel driving voltages $G_1$ to $G_n$ between odd-numbered ones and even-numbered ones of consecutive frames FM1 to FM10 to the source driver 13 via the transmission line LL. In the example shown in FIG. 5, the polarity inversion signal POL has logic level 0 indicating a negative polarity at the point in time (marked with a triangle) of the initial rising edge of the line start signal LS in each odd-numbered frame FM. The polarity inversion signal POL has logic level 1 indicating a positive polarity at the point in time (marked with a triangle) of the initial rising edge of the line start signal LS in each even-numbered frame FM.

As shown in FIG. 5, when the polarity inversion signal POL is normally supplied to the source driver 13 via the transmission line LL, the value of polarity inversion signal POL is inverted frame by frame. The values of the polarity inversion signal POL taken in at the respective eight consecutive frames, i.e., the polarity inversion signals PL1 to PL8 do not all have logic level 0 (or 1). As shown in FIG. 5, the polarity inversion abnormality detection circuit 140 thus supplies the abnormality detection signal ERR maintained at logic level 0, which indicates the absence of an abnormality, to the control part 11.

Figure 6:
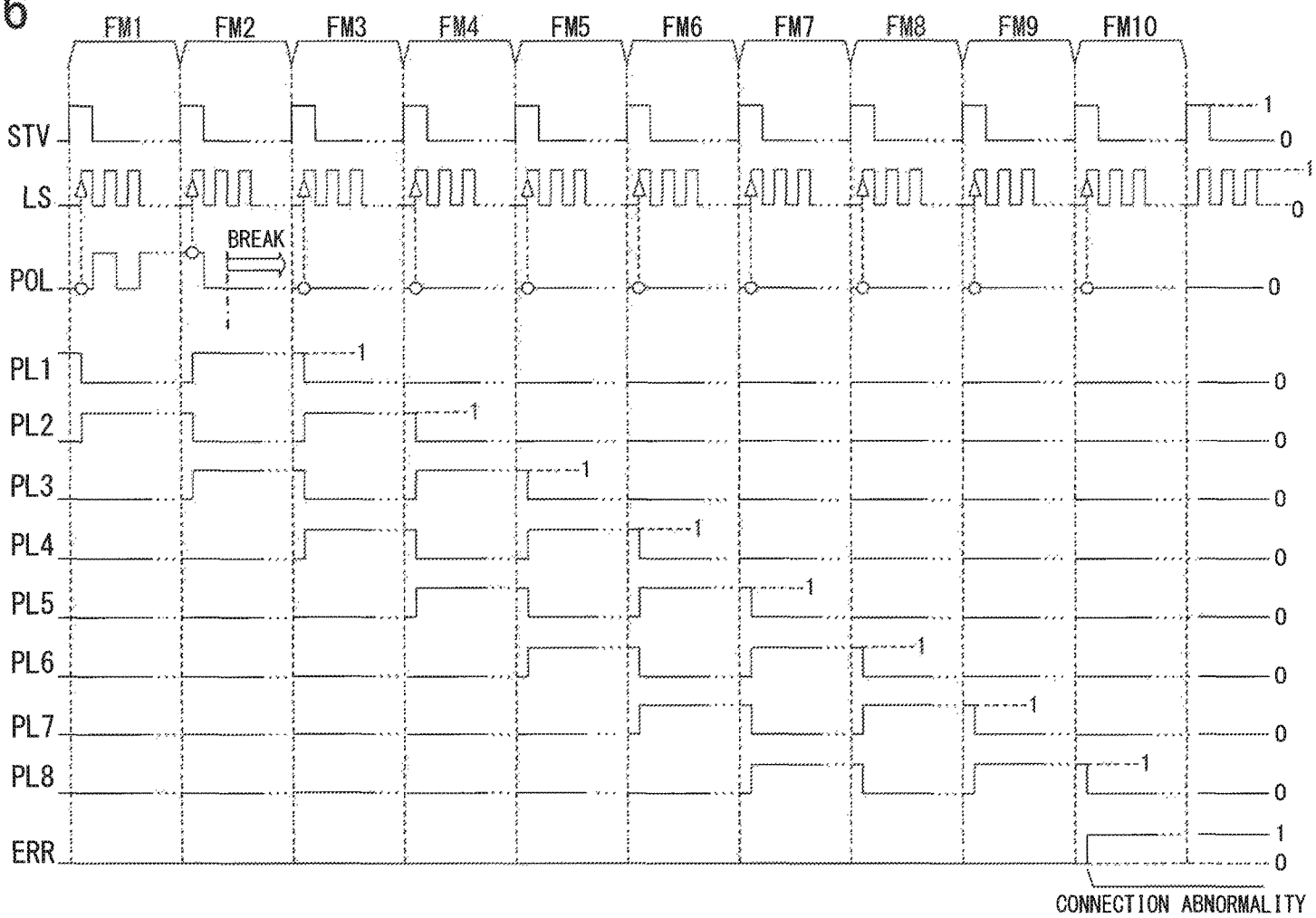
FIG. 6 is a second timing chart for describing the operation of the polarity inversion abnormality detection circuit 140.

Suppose that, as shown in FIG. 6, the transmission line LL breaks at frame FM2, and the polarity inversion signal POL received by the source driver 13 is thus fixed to logic level 0. In such a case, the values of the polarity inversion signal POL taken in at respective eight subsequent frames FM3 to FM10, i.e., the polarity inversion signals PL1 to PL8 all have logic level 0. When the value (logic level 0) of the polarity inversion signal POL is taken in at the final frame FM10 among the eight consecutive frames FM3 to FM10, the polarity inversion abnormality detection circuit 140 switches the abnormality detection signal ERR from the state of logic level 0 indicating the absence of an abnormality to the state of logic level 1 indicating the occurrence of an abnormality. The polarity inversion abnormality detection circuit 140 then supplies the abnormality detection signal ERR of logic level 1, which indicates the occurrence of an abnormality, to the control part 11. According to such an abnormality detection signal ERR, the driver stop control part of the control part 11 supplies the driver stop signal STOP to the source driver 13. According to the driver stop signal STOP, the source driver 13 stops supplying the pixel driving voltages $G_1$ to $G_n$ to the display device 20. As a result, the display operation of the display device 20 stops.

Figure 7:
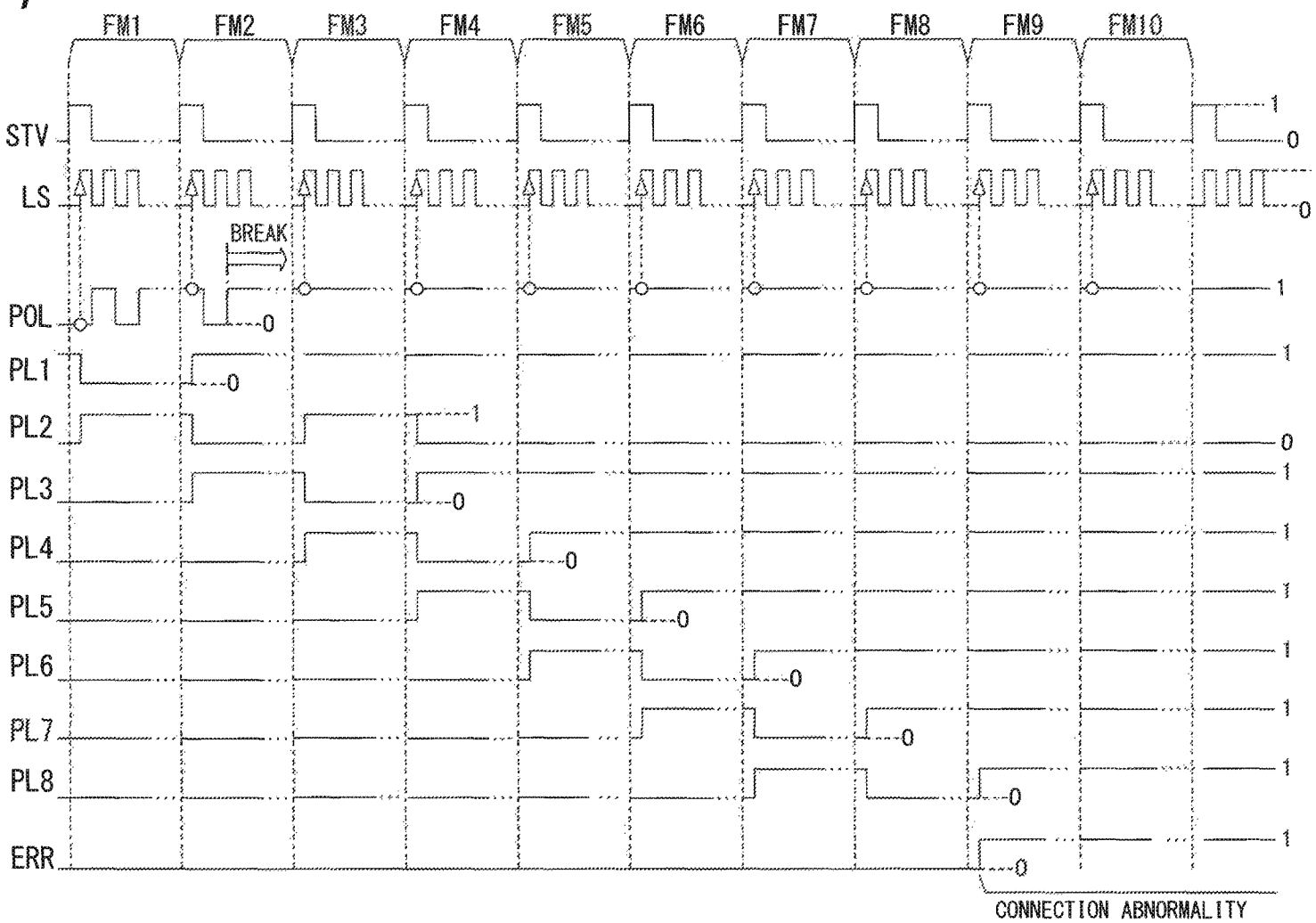
FIG. 7 is a third timing chart for describing the operation of the polarity inversion abnormality detection circuit 140.

Suppose that, as shown in FIG. 7, the transmission line LL breaks at frame FM2, and the polarity inversion signal POL received by the source driver 13 is fixed to logic level 1 as shown in FIG. 7. In such a case, the values of the polarity inversion signal POL taken in at respective eight consecutive frames FM2 to FM9 including frame FM2, i.e., the polarity inversion signals PL1 to PL8 all have logic level 1. When the value (logic level 1) of the polarity inversion signal POL is taken in at the final frame FM9 among the eight consecutive frames FM2 to FM9, the polarity inversion abnormality detection circuit 140 switches the abnormality detection signal ERR from the state of logic level 0 indicating the absence of an abnormality to the state of logic level 1 indicating the occurrence of an abnormality. The polarity inversion abnormality detection circuit 140 then supplies the abnormality detection signal ERR of logic level 1, which indicates the occurrence of an abnormality, to the control part 11. According to such an abnormality detection signal ERR, the driver stop control part of the control part 11 supplies the driver stop signal STOP to the source driver 13. According to the driver stop signal STOP, the source driver 13 stops generating the pixel driving voltages $G_1$ to $G_n$ and stops operating. As a result, the display device 20 stops its display operation.

As described above, the polarity inversion abnormality detection circuit 140 determines that an abnormality occurs in the transmission line LL when the signal level of the polarity inversion signal POL received from the control part 11 via the transmission line LL is constant, i.e., fixed to logic level 0 (FIG. 6) or logic level 1 (FIG. 7) for eight frame periods. The polarity inversion abnormality detection circuit 140 then supplies the abnormality detection signal ERR of logic level 1 indicating the occurrence of an abnormality in the transmission line LL to the control part 11. According to the abnormality detection signal ERR of logic level 1, the control part 11 stops supplying the pixel driving voltages $G_1$ to $G_n$ to the display device 20. This stops the display operation of the display device 20. Even if a connection failure such as a break occurs in the transmission line LL for transmitting the polarity inversion signal POL to the source driver 13, the occurrence of burning of the display device 20 can thus be prevented.

In the foregoing embodiment, the polarity inversion abnormality detection circuit 140 determines that an abnormality such as a break occurs in the transmission line LL when the signal level of the polarity inversion signal POL is fixed for eight frame periods. However, the abnormality-determining periods in which the polarity inversion signal POL is at a constant level are not limited to eight frame periods.

For example, when the change cycle of the polarity inversion signal POL by specification is 19 frame periods, the polarity inversion abnormality detection circuit 140 may determine that an abnormality occurs when the signal level of the polarity inversion signal POL is fixed to logic level 0 or 1 for 20 frame periods. In such a case, the number of stages of the flip-flops F and the selectors S in the shift register part 141 of the polarity inversion abnormality detection circuit 140 is 20. The AND gate circuit ANG and the NOR gate circuit NRG of the abnormality determination part 142 have 20 input signals each.

When the change cycle of the polarity inversion signal POL by specification is one frame period, the polarity inversion abnormality detection circuit 140 may determine that an abnormality occurs when the signal level of the polarity inversion signal POL is fixed to logic level 0 or 1 for two frame periods. In such a case, the flip-flops F3 to F8 and the selectors S3 to S8 in the shift register part 141 of the polarity inversion abnormality detection circuit 140 are not needed. A two-input AND gate receiving the polarity inversion signals PL1 and PL2 is employed as the AND gate circuit ANG of the abnormality determination part 142. A two-input NOR gate receiving the polarity inversion signals PL1 and PL2 is employed as the NOR gate circuit NRG. That is, the number of stages of the flip-flops F and selectors S in the shift register circuit 141 and the numbers of input signals of the AND gate circuit ANG and the NOR gate circuit NRG are determined by the change cycle of the polarity inversion signal POL defined by specification.

In the foregoing embodiment, the polarity inversion abnormality detection circuit 140 detects a break of the transmission line LL by using the polarity inversion signal POL itself received via the transmission line LL. However, an abnormality of the transmission line LL may be detected by using a signal that is taken into the inside of gradation voltage conversion part 132 and corresponds to the polarity inversion signal POL.

In the foregoing embodiment, the abnormality determination part 142 of the polarity inversion abnormality detection circuit 140 uses the AND gate circuit ANG to detect that the plurality of polarity inversion signals (PL1 to PL8) have logic level 1. However, any circuit may be employed as long as the circuit can detect that the plurality of polarity inversion signals have logic level 1. Similarly, the abnormality determination part 142 uses the NOR gate circuit NRG to detect that the plurality of polarity inversion signals (PL1 to PL8) have logic level 0. However, any circuit may be employed as long as the circuit can detect that the plurality of polarity inversion signals have logic level 0. For example, comparators may be employed instead of the AND gate circuit ANG and the NOR gate circuit NRG.

In summary, the display driver according to the present invention may include the following driving voltage generation part and polarity inversion abnormality detection part. The driving voltage generation part (132 and 133) generates voltages as pixel driving voltages ($G_1$ to $G_n$) by inverting polarities of voltages representing or corresponding to luminance levels of respective pixels based on a video signal (VS) according to a polarity inversion signal (POL) received via a transmission line (LL), and supplies the pixel driving voltages ($G_1$ to $G_n$) to a display device (20). The polarity inversion abnormality detection part (140) generates an abnormality detection signal (ERR) indicating an abnormality of the transmission line when the polarity inversion signal indicates only one constant polarity for a period of N frames (N is an integer greater than or equal to 2) of the video signal. According to such a configuration, the operation of the display driver can be forcefully stopped according to the abnormality detection signal to prevent the occurrence of burning of the display device even if an abnormality such as a break occurs in the transmission line for transmitting the polarity inversion signal (POL).

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

This application is based upon and claims the benefit of priority from the prior Japanese Patent Application No. 2016-175197 filed on Sep. 8, 2016, the entire contents of which are incorporated herein by reference.

What is claimed is:

1. A display driver for supplying a pixel driving voltage corresponding to a video signal to a display device, said display driver comprising:

a driving voltage generation part configured to generate a voltage as said pixel driving voltage by inverting a polarity of a voltage representing a luminance level of each pixel based on said video signal according to a polarity inversion signal received via a transmission line, said polarity inversion signal alternately indicating either one of positive and negative polarities; and a polarity inversion abnormality detection part configured to generate an abnormality detection signal indicating an abnormality of said transmission line when said polarity inversion signal indicates only one constant polarity for a period of N frames (N is an integer greater than or equal to 2) of said video signal.

2. The display driver according to claim 1, wherein said polarity inversion signal is a binary signal of which a level alternates between a state of logic level 0 and a state of logic level 1, and said polarity inversion abnormality detection part includes a register that stores the level of said polarity inversion signal in each frame period for the N frames, and an abnormality determination part that generates said abnormality detection signal when all the levels of said polarity inversion signal for the N frames stored in said register are the logic level 0 or the logic level 1.

3. A display apparatus for displaying an image based on a video signal on a display device, said display apparatus comprising:

a display driver; and a control part configured to supply a polarity inversion signal alternately indicating either one of positive and negative polarities to said display driver via a transmission line, wherein said display driver includes a driving voltage generation part configured to supply a voltage as a pixel driving voltage to said display device, the voltage being obtained by inverting a polarity of a voltage representing a luminance level of each pixel based on said video signal according to said polarity inversion signal received via the transmission line, and a polarity inversion abnormality detection part configured to supply an abnormality detection signal indicating an abnormality of said transmission line to said control part when said polarity inversion signal indicates only one constant polarity for a period of N frames (N is an integer greater than or equal to 2) of said video signal.

4. The display apparatus according to claim 3, wherein said control part includes a driver stop control part configured to supply a driver stop signal to said display driver according to said abnormality detection signal, and said display driver stops supplying said pixel driving voltage to said display device according to said driver stop signal.

5. The display device according to claim 4, wherein said polarity inversion signal is a binary signal of which a level alternates between a state of logic level 0 and a state of logic level 1, and said polarity inversion abnormality detection part includes a register that stores the level of said polarity inversion signal in each frame period for the N frames, and an abnormality determination part that outputs said abnormality detection signal when all the levels of said polarity inversion signal for the N frames stored in said register are the logic level 0 or the logic level 1.

6. The display apparatus according to claim 3, wherein said polarity inversion signal is a binary signal of which a level alternates between a state of logic level 0 and a state of logic level 1, and said polarity inversion abnormality detection part includes a register that stores the level of said polarity inversion signal in each frame period for the N frames, and an abnormality determination part that outputs said abnormality detection signal when all the levels of said polarity inversion signal for the N frames stored in said register are the logic level 0 or the logic level 1.

* * * * *